US007793405B2

(12) United States Patent
Deaett et al.

(10) Patent No.: US 7,793,405 B2
(45) Date of Patent: Sep. 14, 2010

(54) METHOD FOR CONSTRUCTING MICROWAVE ANTENNAS INCORPORATED WITHIN NONWOVEN FABRIC

(75) Inventors: Michael A. Deaett, North Kingstown, RI (US); William H. Weedon, III, Warwick, RI (US); Terezie Zapletalova, Raliegh, NC (US)

(73) Assignee: Applied Radar Inc, North Kingstown, RI (US)

( * ) Notice: Subject to any disclaimer, the term of this patent is extended or adjusted under 35 U.S.C. 154(b) by 16 days.

(21) Appl. No.: 12/051,998

(22) Filed: Mar. 20, 2008

(65) Prior Publication Data

US 2008/0256785 A1 Oct. 23, 2008

Related U.S. Application Data

(63) Continuation of application No. 11/113,222, filed on Apr. 23, 2005, now abandoned.

(51) Int. Cl.
*H01P 11/00* (2006.01)

(52) U.S. Cl. ..... 29/600; 340/572.1

(58) Field of Classification Search ..... 029/600–601, 029/830–831, 846–852, 729, 739; 343/700 MS, 343/795, 809; 340/572.1, 572.7; 235/492
See application file for complete search history.

(56) References Cited

U.S. PATENT DOCUMENTS

| | | | | |
|---|---|---|---|---|
| 5,614,306 | A * | 3/1997 | Jobe et al. | 442/381 |
| 6,123,796 | A * | 9/2000 | Kathmann et al. | 156/249 |
| 6,451,154 | B1 * | 9/2002 | Grabau et al. | 156/300 |
| 6,645,327 | B2 * | 11/2003 | Austin et al. | 156/64 |
| 6,665,931 | B2 * | 12/2003 | Yamaguchi et al. | 29/850 |
| 6,796,732 | B2 * | 9/2004 | Kobayashi et al. | 400/120.01 |
| 7,227,470 | B2 * | 6/2007 | Nedblake | 340/572.1 |
| 2002/0062974 | A1 * | 5/2002 | Curro et al. | 174/68.1 |

* cited by examiner

*Primary Examiner*—Minh Trinh
(74) *Attorney, Agent, or Firm*—Maurice M. Lynch

(57) ABSTRACT

A method of constructing fabric microwave antennas with a calendering apparatus which comprises: providing a calendaring apparatus having a plurality of roller two of said rollers are arranged as a nip or meeting point; heating said rollers located at said nip; setting the pressure at said nip or meeting point of said rollers; shaping antenna patches from conductive fabric; feeding at least one roll of carrier fabric into said heated and pressurized nip; placing said preformed conductive patches on to the carrier fabric before said carrier fabric enters said heated and pressurized nip of the calendering apparatus so that said preformed conductive patches and said carrier fabric are bonded or calendered by the heat and pressure effects of said nip; and cutting said calendered or bonded layers of conductive and non-conductive fabric into desired shapes for incorporation into flexible structures.

4 Claims, 3 Drawing Sheets

METHOD FOR CONSTRUCTING MICROWAVE ANTENNAS INCORPORATED WITHIN NONWOVEN FABRIC

CROSS REFERENCES TO RELATED APPLICATIONS

This is a continuing application from application Ser. No. 11/113,222 Apr. 23, 2005 now abandoned. In that application, the original claims were directed to a device, whereas this application is for a method of making the device.

The examiner for the previous application was Peter Y. Choi, art unit 1771

As there are no new inventors with this application and the previous inventors were responsible for the work on these claims, it is requested that the original oath and declaration be used for this divisional application under 37 CFR 1.53 (d).

BACKGROUND OF THE INVENTION

Microwave antennas are constructed today by using multilayer circuit board technology. These antennas can be inserted into garments only with difficulty and the resulting garment is uncomfortable to wear. Also, since the antenna is added during the garment manufacture, the cost is increased.

There is prior art in the area of fabric antennas. Van Heerden et al. in U.S. Pat. No. 6,677,917 describes a fabric antenna that consists of a radio frequency transponder and a radio frequency circuit enclosed in a housing and this is attached to conductive thread, glue and substrate. The antenna is enclosed in a seam of the garment. Van Heerden, in U.S. Pat. No. 6,686,038, describes a conductive fiber that is capable of being sewn, woven or knitted into a conductive mesh.

Another relevant patent is U.S. Pat. No. 6,433,743 by Massey et al. This describes a patch antenna that can be incorporated into a garment. The patch antenna comprises two spaced layers of electrically conductive fabric sandwiched around a non-conductive layer of fabric with a connection between the two conductive layers. The resulting patch is then incorporated into a garment.

GPS antennas have also been incorporated into garments, see Krasner U.S. Pat. No. 6,259,399. In this patent, the inventor describes an antenna "attached to the garment." This is not the case in this application.

In this application, a non-woven fabric, a conductive fabric or a wire-mesh or and adhesive flexible conductive mesh such as Shield-X, which is able to conduct microwave energy is used to make a PATCH antenna. Conductive non-woven fabric is a non-woven fabric that has incorporated a conductive metal. See U.S. Pat. No. 6,841,244 by Foss et al. This patent describes an anti-microbial fiber that contains an additive comprised of "a zeolite of a metal selected from the group consisting of silver, zinc, copper and tin."

SUMMARY OF THE INVENTION

An object of this invention is to describe a method for construction patch antennas from non-woven fabric by calendering.

In the preferred embodiment of this invention, a layer or layers of conductive fabric comprises the conductive material upon which microwave energy can be channeled producing an antenna. This conductive fabric is specifically shaped into a patch antenna encapsulated by a calendering process in layers of non-conductive fabric.

Non-woven fabrics are broadly defined as sheet or web structures bonded together by entangling fiber or filaments (and by perforating films) mechanically, thermally or chemically. They are flat, porous sheets that are made directly from separate fibers or from molten plastic or plastic film. They are not made by weaving or knitting and do not require converting the fibers to yarn. Non-woven fabrics are engineered fabrics that may have a limited life, may be single-use fabric or may be a very durable fabric. Non-woven fabrics also provide specific functions such as absorbency, liquid repellency, resilience, stretch, softness, strength, flame retardancy, washability, cushioning, filtering, bacterial barrier and sterility.

BRIEF DESCRIPTION OF THE INVENTION

DETAILED DESCRIPTION OF THE PREFERRED EMBODIMENT

Figure 1:
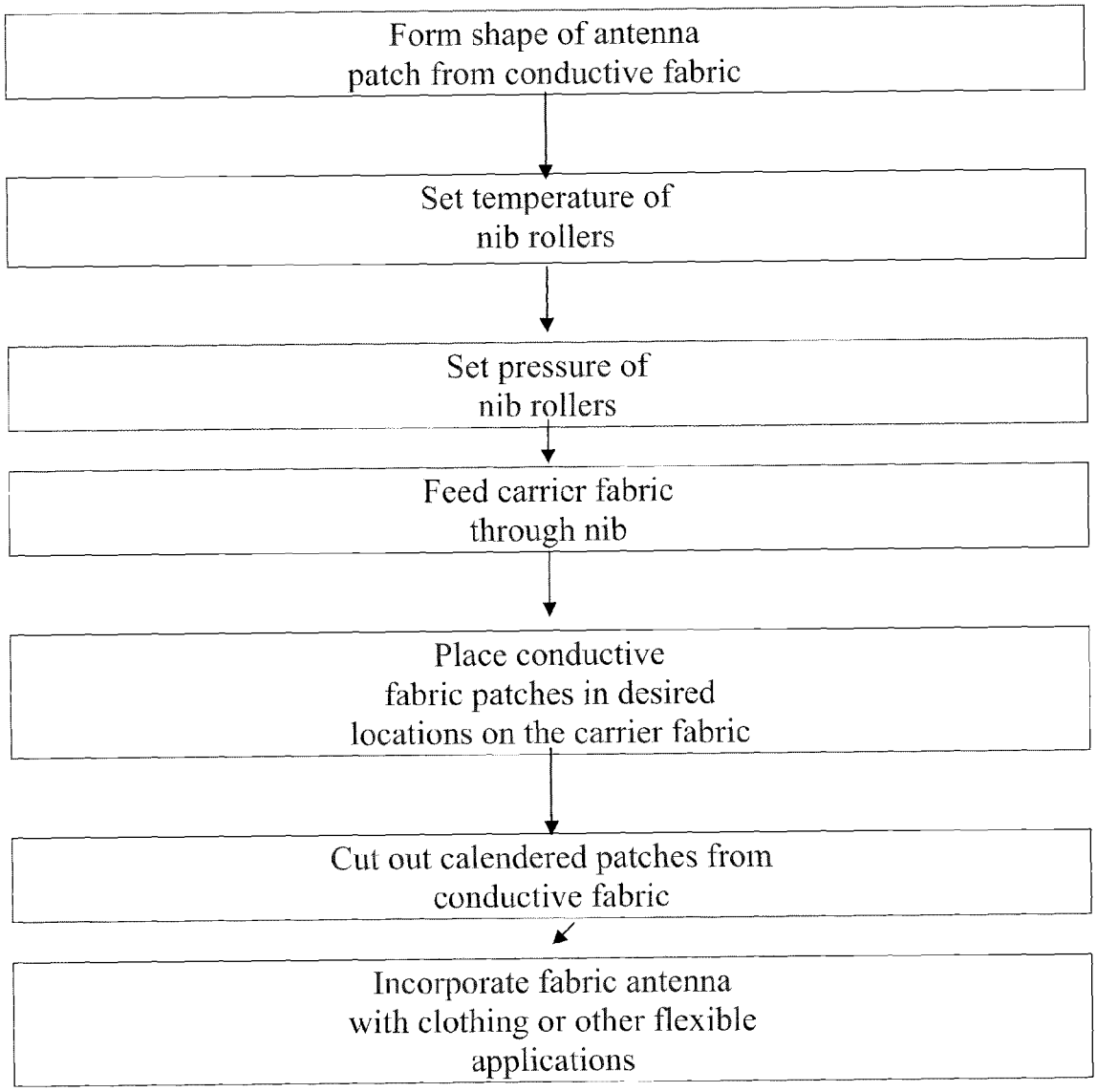
FIG. 1 depicts a block diagram of the process of constructing a non-woven fabric antenna.

FIG. 1 is a block diagram of the method of calendaering conductive and non-conductive fabrics to construct a flexible PATCH microwave antenna. The patches are cut out of the conductive material and placed on a carrier fabric before entering into the calendering apparatus. It is important to this process that the calendaring nib is set to the proper pressure. It is also important that each roller at the nib be set to a specific temperature so that the fabrics adhere to each other. Once the fabrics are calendered, the antenna patches and be cut to a desired shape, pattern and incorporated in to clothing or other fabrics for flexible application.

Figure 2:
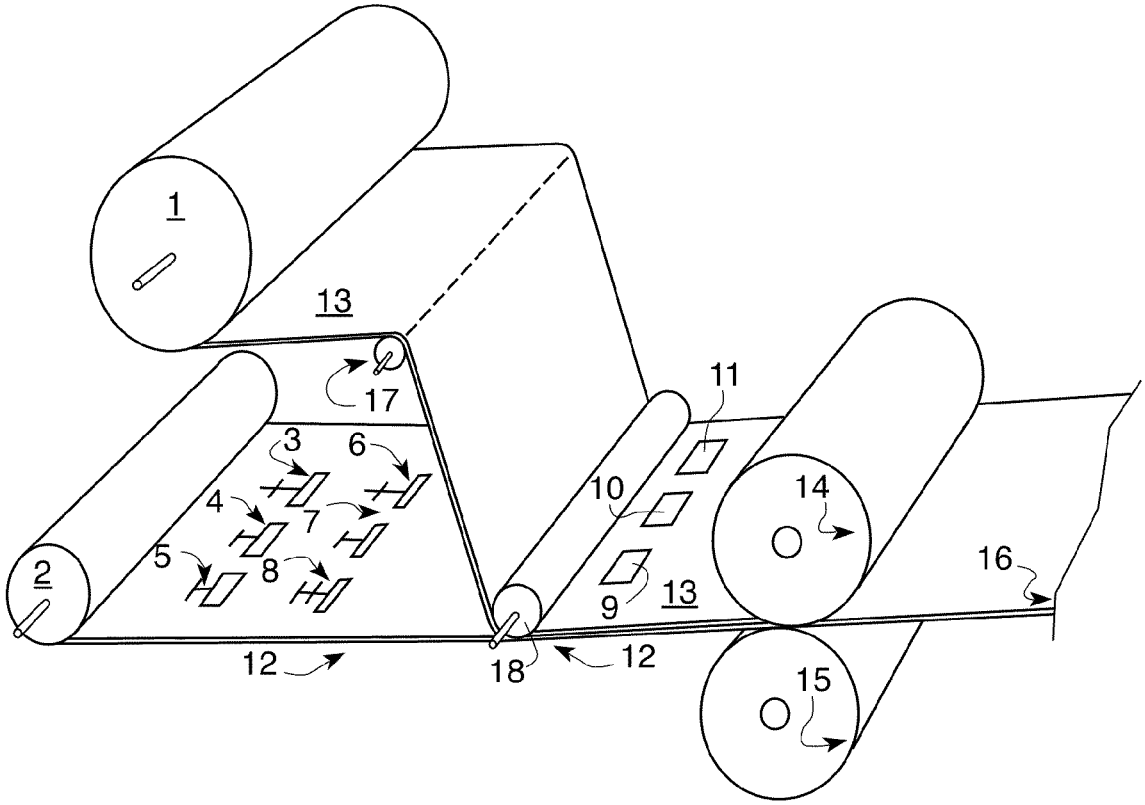
FIG. 2 shows the calendering process.

FIG. 2 depicts one method for constructing multilayer antennas using a multiple raw mesh calender, 14 and 15. This calender produces the non-woven fabric, 16. Raw fibrous meshes are stored on rolls 1 and 2. The mesh of roll 1, labeled 13, is fed over the traveler roll 17 and down to traveler roll 18. The raw fibrous mesh, 12, is fed from the roller labeled 2 across a flat surface to the traveler roller labeled 18. During the motion of raw mesh 12 from roll 2 to roller 18 there is deposited onto mesh 12 by automatic means precut pieces of conductive fabric. These fabric pieces, 3, 4, 5, 6, 7, 8 may be positioned to effect a precise alignment with fabric pieces 9, 10 and 11. The later pieces 9, 10, 11 are automatically deposited onto mesh 13 after proceeding under roller 18. The calender then applies pressure and heat to produce the composite fabric labeled 16.

Figure 3:
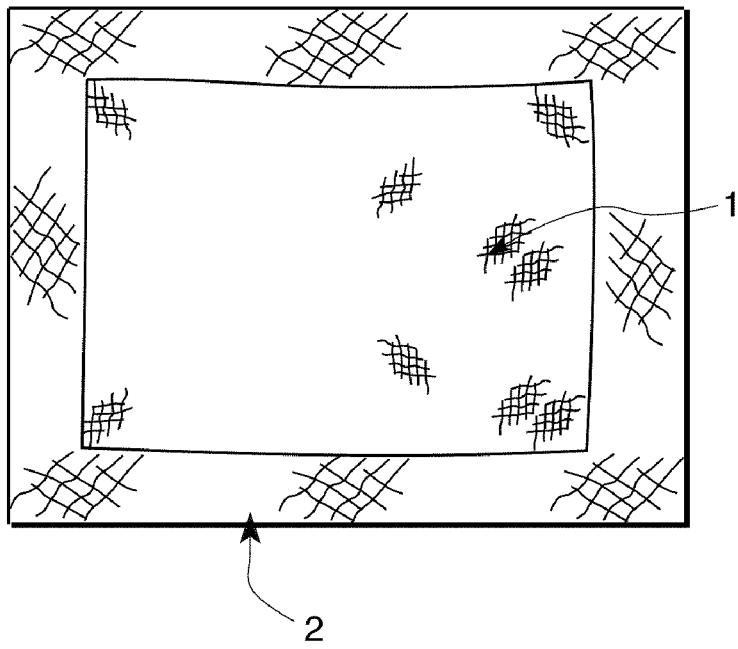
FIG. 3 shows a non-woven fabric incorporating an antenna patch made of a non-woven metalized fabric.

FIG. 3 shows conductive non-woven fabric 1 shaped as an antenna patch encapsulated in the non-conductive, non-woven fabric 2.

Figure 4:
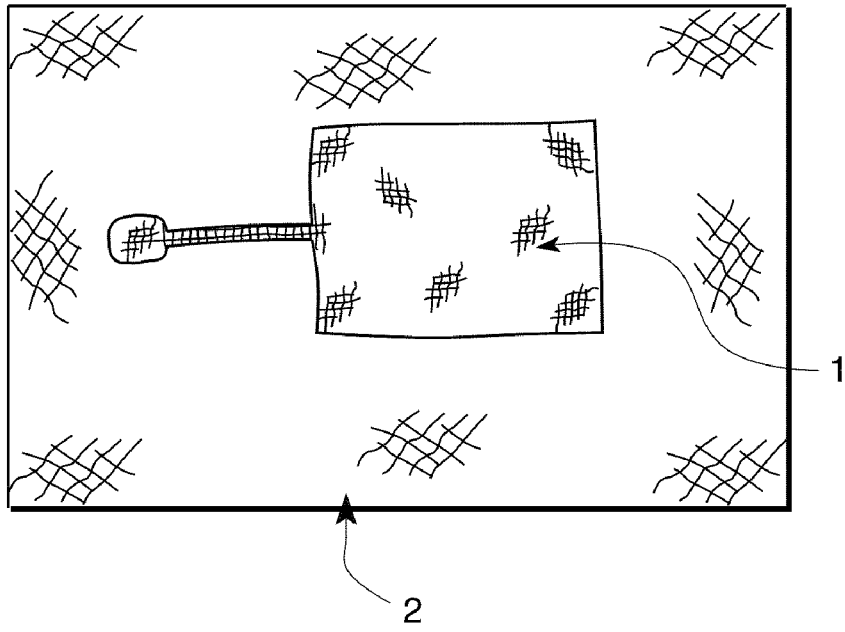
FIG. 4 shows a woven fabric incorporating an antenna with impedance matching circuit made of a non-woven metalized fabric.

FIG. 4 shows conductive non-woven fabric 1 formed as an antenna with a matching circuit microwave circuit encapsulated in non-conductive, non-woven fabric 2.

What is claimed is:

1. A method of constructing fabric microwave antennas with a calendering apparatus which comprises:

providing a calendaring apparatus having a plurality of roller two of said rollers are arranged as a nip or meeting point;

heating said rollers located at said nip;

setting the pressure at said nip or meeting point of said rollers shaping antenna patches from conductive fabric;

feeding at least one roll of carrier fabric into said heated and pressurized nip;

placing said preformed conductive patches on to the carrier fabric before said carrier fabric enters said heated and pressurized nip of the calendering apparatus so that said preformed conductive patches and said carrier fabric are bonded or calendered by the heat and pressure effects of said nip; and cutting said calendered or bonded layers of conductive and non-conductive fabric into desired shapes for incorporation into flexible structures.

2. The method according to claim one comprising the heated roller or nip step wherein the temperature in the roll to which said preformed conductive patches come into contacts of said calendering apparatus is maintained between 100 to 600 degrees Fahrenheit with an optimal temperature of 293 degrees Fahrenheit and the temperature of the roll to which said carrier fabric touches said calendering apparatus is maintained between 100 to 600 degrees Fahrenheit with an optimal temperature of 300 degrees Fahrenheit and the pressure between said calender rolls or nib is maintained between 500 and 2000 pounds per square inch with an optimal pressure maintained at 1000 pounds per square inch.

3. The method according to claim one wherein said preformed conductive patches are excised from said conductive fabric using a computer directed laser cutting device.

4. A method according to claim 1 wherein two layers of non-conductive non-woven fabric are used to provide both a flexible backing and an encapsulating structure for a layer of conductive non-woven fabric, conductive woven fabric, conductive mesh or conductive thread which may not adhere to a single non-woven fabric backing.

* * * * *

UNITED STATES PATENT AND TRADEMARK OFFICE

CERTIFICATE OF CORRECTION

PATENT NO. : 7,793,405 B2
APPLICATION NO. : 12/051998
DATED : September 14, 2010
INVENTOR(S) : Michael A. Deaett, Terezie Zapletalova and William H. Weedon, III It is certified that error appears in the above-identified patent and that said Letters Patent is hereby corrected as shown below:

Col. 1, lines 18-19; insert;

--This invention was made with Government support under contract number DAAH01-03-C-R200 awarded by DAARPA. The Government has certain rights in the invention.--

Signed and Sealed this
Eighth Day of March, 2011

David J. Kappos

David J. Kappos
*Director of the United States Patent and Trademark Office*